United States Patent [19]

Kuo

[11] 4,219,282

[45] Aug. 26, 1980

[54] WRITING IMPLEMENT

[76] Inventor: Chun-Liang Kuo, No. 328, 2nd Fl., Cheng Yi North Rd., San Chung City, Taipei Hsien, Taiwan

[21] Appl. No.: 919,039

[22] Filed: Jun. 26, 1978

[51] Int. Cl.[2] ..... B43K 21/16

[52] U.S. Cl. ..... 401/57; 401/65; 401/82; 401/85; 401/90; 401/94

[58] Field of Search ..... 401/92–94, 401/86, 87, 53, 80, 81, 57, 82, 65, 88, 67, 85, 89, 90

[56] References Cited

U.S. PATENT DOCUMENTS

| | | | |
|---|---|---|---|
| 480,188 | 8/1892 | Fornander | 401/57 X |
| 692,440 | 2/1902 | Goldsmith | 401/65 |
| 1,590,126 | 6/1926 | Sheley | 401/57 |
| 1,766,271 | 6/1930 | Turner | 401/81 |
| 2,358,091 | 9/1944 | Lovejoy | 401/65 |
| 3,338,215 | 8/1967 | Chui et al. | 401/82 |
| 3,790,291 | 2/1974 | Hung et al. | 401/57 |
| 3,918,819 | 11/1975 | Liu | 401/57 |

FOREIGN PATENT DOCUMENTS

| | | | |
|---|---|---|---|
| 269528 | 10/1950 | Switzerland | 401/90 |

*Primary Examiner*—Edgar S. Burr
*Assistant Examiner*—Steven A. Bratlie
*Attorney, Agent, or Firm*—Tak Ki Sung

[57] ABSTRACT

This invention relates to a writing implement comprising an outer casing, a coil spring disposed within the casing, an inner tube inserted through the coil spring and having a plurality of presharpened leads stored therewithin, and a capping member inserted over the open end of the inner tube. The front (writing) end of the inner tube is split into two clamping halves. The front end of the coil spring is formed into a hooked portion which slides along the slot formed between the clamping halves to allow the expelling and feeding of presharpened lead pieces into the clamping halves.

7 Claims, 10 Drawing Figures

FIG. 8
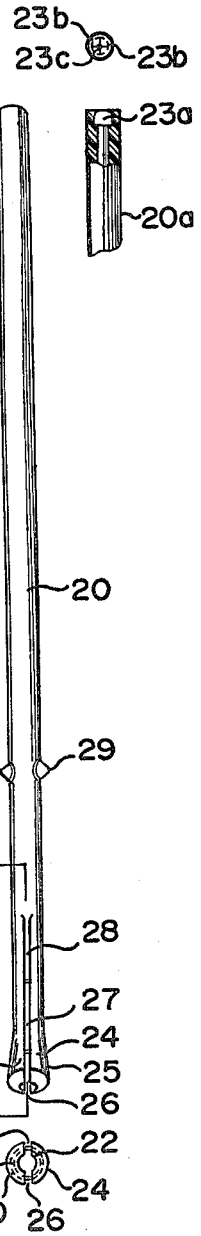
FIG. 7
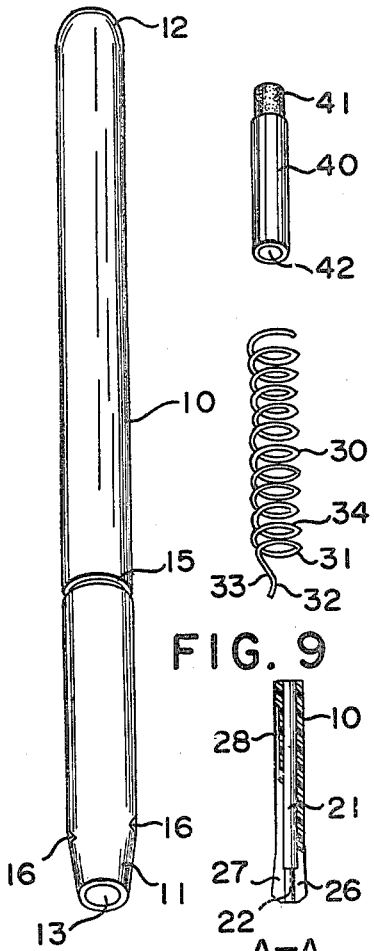
FIG. 9

WRITING IMPLEMENT

The present invention is related to a writing and drawing pencil, in which the lead can be changed automatically and in which the leads are presharpened, thus requiring no sharpening.

Ever since the introduction of "presharpened" pencils in the market, there have been numerous forms and kinds of such pencils in use. However, upon further investigation, it is found that the construction of these pencils is not only very complicated, but also inconvenient in use and have many disadvantages.

The primary objective of the present invention is to provide a special construction in a presharpened pencil in order to facilitate writing, as well as to eliminate the disadvantages of the conventional presharpened pencils.

The following are the advantageous characteristics of the present invention:

(1) The present invention adopts the "direct pressing" method in which the user employs a one-handed operation to quickly push out or change the pencil lead for the purpose of writing. The convenience and simplicity of this operation have never been shown. The previous presharpened pencils have never exhibited such desirable characteristics.

(2) While in use, the lead in the present pencil is tightly pressed against the front end of the pencil so that there is no wobbling or vibrating, thus providing an extremely stable operation.

(3) When changing or refilling the leads in the present pencil, the user's fingers do not come in contact with the somewhat poisonous lead. This is one of the most outstanding advantages of the present invention—to prevent the fingers from getting dirty which is beneficial to the health of the users (e.g. students).

(4) In the present invention, the lead sections do not require lead holders or collars which means easier manufacturing and lower costs.

(5) The present invention allows the retraction of an exposed lead into the pencil. Thus, there is no need for an additional cap to cover or protect the lead.

(6) Since the construction of the present invention is particularly simple, the parts can easily be made without fabrication by injection molding. As the manufacturing process is simplified, the cost is decreased to a large extent.

In addition to those described above, the other objectives, effectiveness and features of the present invention are described in detail as follows in conjunction with the appended drawings:

FIG. 7 is a three-dimensional sketch of the separate parts of an embodiment of the present invention.

FIG. 8 is a partial cross-sectional view of the inner tube of an embodiment of the present invention.

FIG. 9 shows the cross-sectional view along line AA in FIG. 8.

Figure 1:
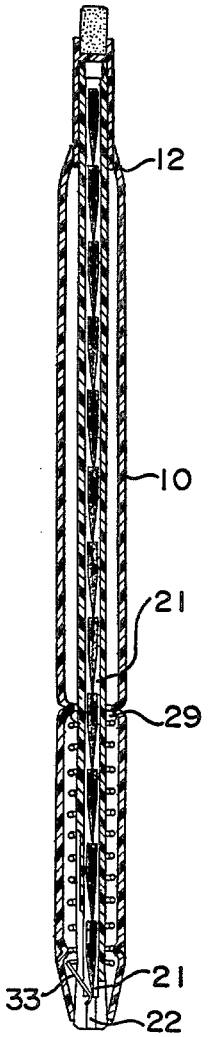
FIGS. 1–5 are cross-sectional diagrams of an embodiment of the present invention, showing the various states of operation.

As shown in FIG. 7, the automatic lead-changing, presharpened writing and drawing pencil of the present invention consists of mainly an outer casing 10, an inner tube 20, a coil spring 30, and a capping member for the inner tube 40. The outer casing 10 is made of a hollow round tube by a pipe-drawing extrusion method, with the two opposite ends 11, 12 being tapered to form a generally conical shape. Each end has an appropriate opening 13 and 14 respectively, which opening has a smaller diameter than the casing 10. On outer casing 10, a circular groove 15 is provided near end 11 at about one third of the length of the casing 10. Two undercuts 16, the purposes of which will be explained later, are also provided near end 11. The interior of tube 20 is provided with a channel 21 in which a plurality of leads 50 are stored. The foremost end of channel 21 is formed into a front tube channel 22 having a slightly smaller diameter. The purpose for the smaller diameter of front tube channel 22 is to prevent the foremost one of the pencil leads 50 from passing therethrough, so that the leads 50 are held within tube 20. The other end of the tube channel 21 is made into a rear tube channel 23 (FIG. 2) for the purpose of adding new leads 50. The front end of inner tube 20 is enlarged to form conical head 24, in which are cut two slip slots 26, 27, bisecting said enlarged conical head 24 into two crescent lead clamps 25. One slot 26 is shorter (about one half of the length of one lead section which is usually about 1–1.5 cm long) and the other slot 27 is much longer, about five times the length of slot 26. The closed end of slot 27 is connected to slip channel 28, having a bottom wall and two side walls and formed by excavating in the direction of slot 27 on the wall of internal tube 20. The closed end of channel 28 has a sloping bottom wall to facilitate the gliding of end 32 of coil spring 30 thereon. In addition, two protrusions 29 are provided on the exterior surface of tube 20, at a distance of one third the length of tube 20 from conical clamp 25. The protrusions 29 are for pressing on coil spring 30 when the tube 20 is placed within outer casing 10 through coil spring 30. It is important to note that at the front end of spring 30, the last coil 31 constitutes a lead-pushing member 33 having a hooked tip 32 bent outwardly, i.e. away from the interior or tube 20. Upon inserting inner tube 20 into outer casing 10 through coil spring 30, care is exercised so that tip 32 is aligned with slot 27 and channel 28. When inner tube 20 is inserted through coil spring 30, the lead-pushing piece 33 at the front end of coil spring 30 is forced into slot 27, causing tip 32 to extend into the junction between tube channel 21 and front tube channel 22. As a result, tip 32 can either effectively press onto or block against pencil lead 50. An eraser block 41 is inserted into capping member 40, having an interior surface 42. Capping member 40 is slipped over the end of inner tube 20 to serve as an actuator button during the use and at the same time as a cap in order to prevent the leads 50 from falling out of tube channel 23.

To assemble the present pencil, firstly, coil spring 30 with lead-pushing piece 33 pointing toward the writing end of the pencil is inserted through opening 14 into the tail portion 12 of outer casing 10. It is lodged at front end 11 inside tube 10. Thereafter, outer tube 10 is pressed at an appropriate location near front end 11 to form two depressions 16 mentioned above, with the second winding 34 of coil spring 30 being tightly fastened thereto. The purpose of fastening at the second winding 34 is to enable same to be coupled with first winding 31 to acquire increased elasticity. That is, by fastening the spring at 31, the elasticity of the front end of the coil spring 30 is increased. After coil spring 30 has been secured, the inner tube 20 is then inserted, with lead clamp 25 being fitted through coil spring 30. Next, lead pushing member 33 of coil spring 30 is glided or rotated into alignment with slot 27. As a result of the alignment, the front ends of the two lead clamps 25 project slightly outside of opening 13 (when the two leads clamps 25 containing no pencil lead therein are pressed together, their outside diameter will be slightly smaller than opening 13, therefore they can project out). After inner tube 20 has been properly inserted, groove 15 which extends circumferentially around outer casing 10 is pressed inwardly onto stoppers 29 on inner tube 20 so as to firmly secure inner tube 20 within outer casing 10. Finally, the open end of capping member 40 is fitted over the tail portion of inner tube 20. An eraser 41 is then fitted into the other open end of capping member 40 which member fits within upper end 12 of outer casing 10, thus completing the assembly of the present invention.

FIG. 8 is another embodiment of the present invention. It differs from the above embodiment in that four pieces of elastic film **23*b* are provided on the interior surface of internal tube 20*a*. The films 24*b* are located near the opening 23*a* of internal tube 20*a*. Accordingly, the opening 23*c* to internal tube 20*a* is reduced so that it is slightly smaller than the outside diameter of the pencil lead 50. Thus, it is apparent that it is not necessary to utilize capping member 40 although the push button function and the prevention of leads 50 from falling out of inner tube 20** are retained. This kind of construction reduces the main members of the present invention to three: the outer casing, the inner tube and the coil spring.

Figure 2:
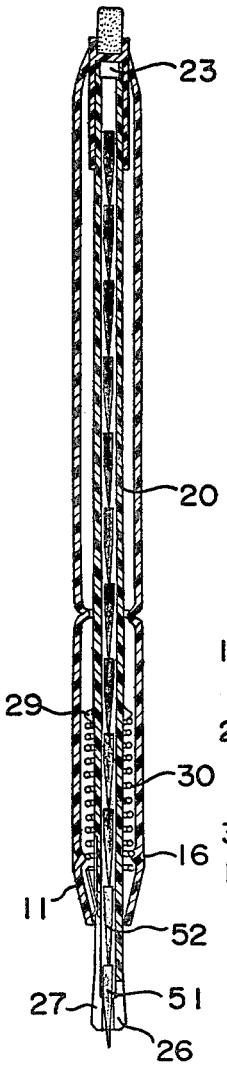
Figure 3:
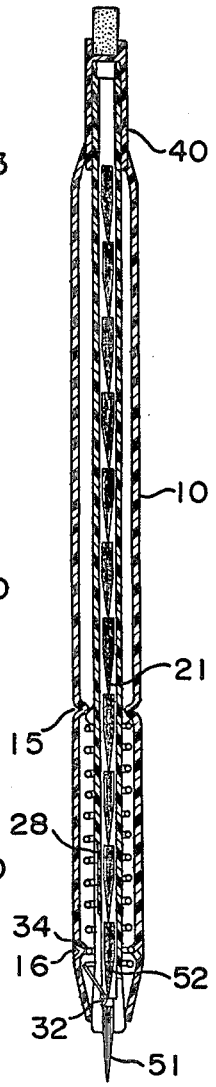
Figure 4:
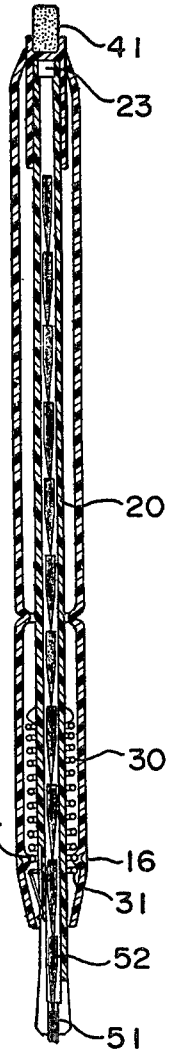
Figure 5:
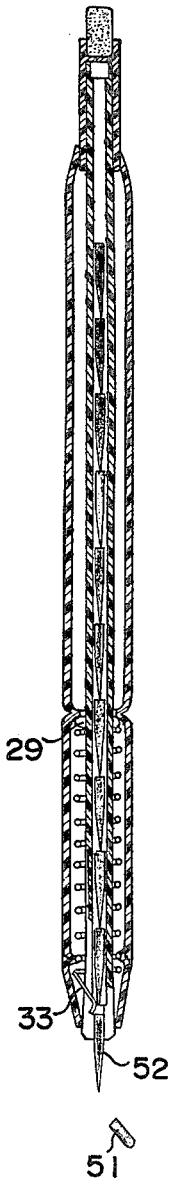
Figure 6A:
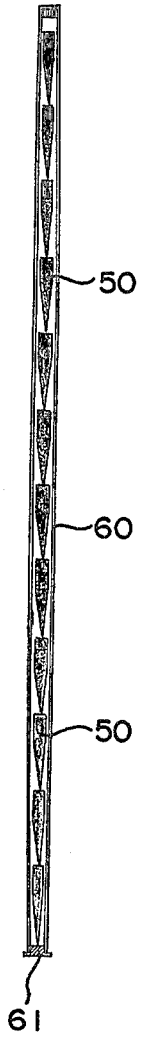
FIG. 6A is a diagram of an embodiment of the present invention having a spare tube for the leads therein.
Figure 6:
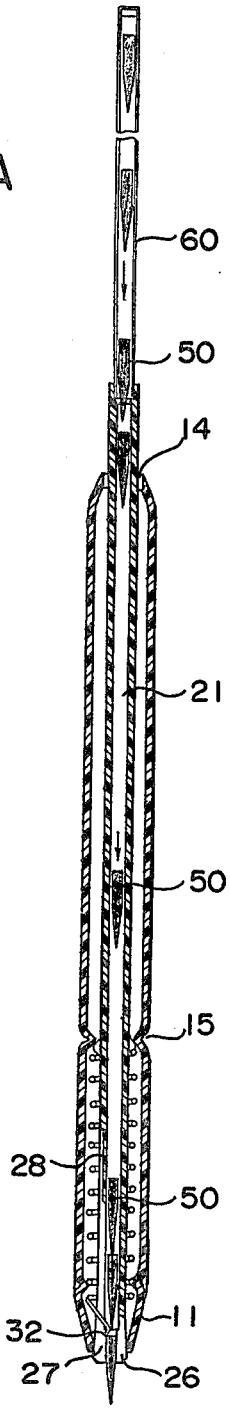
FIG. 6 is a cross-sectional diagram of an embodiment of the present invention, showing an inner tube being filled with lead.

With reference to FIGS. 1–5, these figures show the various stages involved in operating the present pencil. When tube channel 21 of inner tube 20 is completely filled with presharpened lead pieces, the capacity is 12 sections. The lead pieces are stored in an end-to-end fashion with the sharpened end of each piece being pointed towards the writing end of the present pencil. FIG. 1 shows the pencil before being used. When the user starts to press or push end 23 of inner tube downwardly, protrusions 29 force coil spring 30 to be compressed, as in FIG. 2. Lead clamps 25 of inner tube 20 are fully projected outside opening 13 of outer casing 10. On the other hand, lead-pushing member 33 of coil spring 30 slides along slot 27 due to the downward shift of lead clamps 25. When lead-pushing member 33 reaches the end wall of slot 27, it will be forced to slide onto channel 28 upon further pressing. At this time, the first section of pencil lead 51 in inner tube 20 is no longer blocked by lead-pushing member 33 and is subsequently released. It falls automatically through the foremost end of tube channel 21. However, since front tube channel 22 is slightly smaller in diameter than lead 51, the latter is thus retained therewithin. The point of lead 51 extends through the front tube channel 22 and is exposed to the outside as shown in FIG. 2. The user then removes his finger from end 23, thus releasing the pressure. As a result, lead clamps 25 of inner tube 20 is withdrawn into the outer casing 10 as coil spring 30 returns to almost its original length. Lead-pushing member 33 is returned to tube channel 21 after gliding through channel 28 and slot 27. Upon further retraction of inner tube 20, member 33 comes into contact with the blunt end of lead 51, thus pushing lead 51 further out of channel 21 into front tube channel 22. When inner tube 20 is returned to its original position (that is, protrusions 29 are stopped by circular groove 15 on outer casing 10) the first lead section 51 is pushed completely into front tube channel 22 of inner 20, as shown in FIG. 3. As a result of the insertion of lead 51 into lead clamps 25, the outside diameter of the clamps is slightly increased so that the diameter is larger than opening 13 of outer casing 10. When the user presses the pencil down onto the writing surface, an upward pressure is exerted, pushing the front end of inner tube into outer casing 10. Since the outside diameter of the clamps is slightly larger than opening 13, this inward pressure forces the clamps into opening 13 so as to form an extremely tight grip on exposed lead 51. Thus, there is no wobbling or vibrating in lead 51, which leads to a very stable writing or drawing operation. When the first section of lead 51 has become blunt due to use and has to be replaced by a second section of lead 52, the above process may be repeated by pressure down on end 23, making the two lead clamps 25 extend out of outer casing 10 as shown in FIG. 4. By releasing the pressure, the lead-pushing member 33 pushes the second section of lead 52 into channel 22, which pushes the blunt used lead 51 completely out of inner tube 20. However, since lead clamps 25 are still partially open when lead 51 is expelled, the removal of lead 51 is easily performed, without any damage to the point of lead 52 (see FIG. 5). The above description is detailed particularly for the sake of understanding the working principle of the present invention. It should be noted that during actual use, the pushing and releasing movements are continuous and rapid, and that little exertion in handling and operation is required of the user.

In the present invention, the pencil lead, used or not used, can be withdrawn into the pencil as shown in FIG. 1. The user simply puts the front end of an exposed pencil lead against any surface such as a table top and press end 23 of inner tube 20 lightly to have the two lead clamps 25 project slightly outside of opening 13 of outer casing 10 to form an opening. In the meanwhile, the rear blunt portion of the exposed lead forces away hooked tip 32 of lead-pushing member 33 and enters tube channel 21. Thus, as pressure is released, the entire lead section is withdrawn into the tube channels 21 and 22. Therefore, the present invention has the additional advantage of requiring no protective cap or cover for the lead. In the event that it is not desired to have the lead retracting feature in the present invention, this can be accomplished by replacing the hooked tip 33 with a straight portion. However, such an embodiment would require a protective cap to protect the exposed lead.

The lead section used in the present invention will not be limited to pencil lead. Other working implements which can utilize the construction of the present invention and, therefore are within the scope thereof, include colored pencils, crayons, paraffin pencils, and the like.

Furthermore, when all the pencil leads in inner tube 20 have been used up and replacements are required, cork 61 of plastic spare tube 60 filled with a plurality of pencil lead is removed and the entire spare tube is inserted into opening 23 of inner tube 20. The lead pieces 50 are allowed to fall into the tube one by one to fill it completely as shown in FIG. 1. Therefore, according to this invention, the filling of new pencil leads can be done conveniently and without dirtying the fingers of the user. However, should the user prefer, the lead may be inserted individually into inner tube 20 without using plastic spare tube 60.

What is claimed is:

1. A writing implement comprising: an outer casing; a coil spring having one end formed into a hooked portion and the other end being free, the spring being disposed within the outer casing; and an inner tube adapted for insertion into the outer casing and through the coil spring, the inner tube having an inside channel for storing a plurality of presharpened leads therein, the leads being stored in an end-to-end fashion with the sharpened end being pointed towards the front end of the inner tube, the front end of the inner tube being formed into conical clamp portions having two diametrically opposed slots extending from the front end and along the longitudinal axis of the inner tube, the slots having different lengths, the first slot being about ½ the length of a presharpened pencil lead, the second slot being five times the length of the first slot, the end wall of the second slot being excavated on the outside surface and along the longitudinal axis of the inner tube to form a slip channel, the inside diameter of the inner tube being reduced at the front end by an amount sufficient to frictionally withhold the leads therein, a plurality of protrusions being disposed at about ⅓ the length of the inner tube and on the outside surface thereof for compressing the free end of the coil spring the hooked portion of the coil spring being aligned to extend the hooked portion into the second slot and slide onto the slip channel when the coil spring is compressed.

2. The implement of claim 1 wherein the end of the hooked portion of the coil spring is bent outwardly towards the interior surface of the inner tube.

3. The implement of claim 2 wherein a circular groove is provided circumferentially in the outer tube to seal and immoblize the open end of the coil spring within the outer and inner tubes, the groove being located about ⅓ the length from the front end of the implement.

4. The implement of claim 3 wherein a plurality of undercuts are provided near the front end of the outer tube to engage the second winding from the hooked end of the coil spring.

5. The implement of claim 3 wherein a capping member for insertion over the rear end of the inner tube is provided.

6. The implement of claim 5 wherein an eraser is inserted into the free end of the capping member.

7. The implement of claim 5 wherein a plurality of plastic films are provided on the interior surface of the capping member and near the free end thereof for sealing the pencil leads within the inside channel of the inner tube.

* * * * *